United States Patent [19]

Bigham

[11] 3,972,147

[45] Aug. 3, 1976

[54] BUCKET AND CLOSURE MEMBER APPARATUS

[76] Inventor: Robert C. Bigham, Rte. 3, Topeka, Kans. 66608

[22] Filed: Dec. 17, 1971

[21] Appl. No.: 209,030

[52] U.S. Cl. ..... 49/41; 214/145 R

[51] Int. Cl.[2] ..... E06B 3/34; E02F 3/14

[58] Field of Search ..... 214/145, 147; 49/40, 49/41; 294/70

[56] References Cited

UNITED STATES PATENTS

| | | | |
|---|---|---|---|
| 917,746 | 4/1909 | Brown | 49/40 |
| 3,033,395 | 5/1962 | Lowery | 214/145 X |
| 3,451,575 | 6/1969 | Petro | 214/145 X |

*Primary Examiner*—J. Karl Bell

*Attorney, Agent, or Firm*—Fishburn, Gold & Litman

[57] ABSTRACT

A bucket is pivotally mounted on the movable arms of a tractor. A closure member having a first closure member side and second closure member side is pivotally mounted to the bucket with the first closure member side pivotally mounted to the first bucket side and the second closure member side pivotally mounted to the second bucket side. The closure member may be moved to form an enclosure with the bucket or the closure member may be moved back over the bucket so that the bucket may be used conventionally. A first closure member extensible hydraulic ram and second closure member extensible hydraulic ram are provided to move the closure member through a cable apparatus. The closure member front portion is concave in shape so that when the closure member is fully forward the apparatus may be used for conventional bulldozing, grading and the like.

10 Claims, 5 Drawing Figures

INVENTOR.
ROBERT C. BIGHAM
BY
Norman G. Stevenson, Jr.
ATTORNEY

*INVENTOR.*
ROBERT C. BIGHAM
*BY*
Norman G. Stearson, Jr.
ATTORNEY

INVENTOR.
ROBERT C. BIGHAM
BY
Norman G. Stearson, Jr.
ATTORNEY

*INVENTOR.*
ROBERT C. BIGHAM
*BY*
Norman G. Stearson, Jr.
ATTORNEY

BUCKET AND CLOSURE MEMBER APPARATUS

BACKGROUND OF THE INVENTION

This invention relates to load handling buckets with a closure member therefore and the actuating means for the closure member.

Load handling buckets are well known. And, in the past a closure member has been provided to form an enclosed space with the bucket. The closure member, however, has been hinged to the top edge of the bucket and has been actuated by a hydraulic ram pivotally connected to a bracket mounted on top of the closure member and a bracket mounted on top of the bucket. Of course, in the past, many types of bucket loaders without closures have been provided.

A problem solved by this invention is that, if when closing the closure member a solid object, such as a rock or log, is gripped off center by the closure member and bucket, there is no distortion of the closure member because of the means by which the operating cables are cross tied to the closure member hydraulic rams and closure member.

Another problem solved by this invention is that the closure member operating apparatus is not located on top of the bucket and closure member as in the prior art so the closure member operating apparatus does not interfere with operation of the apparatus or become entangled in and damaged by the environment and, also, the apparatus can be operated under lower structures.

Another problem solved by this invention is that with the hydraulically operated closure member on the bucket the range of usefulness of the apparatus is greatly expanded since loose material may be contained so that there is no spillage in transit even when the tractor is moved or bounced hard.

Another problem solved by this invention is that bulky materials such as rocks, posts, limbs, etc., may be handled jointly or severally by the apparatus by grasping them between the closure member front edge and the bucket bottom edge, and, this can be done without disturbing the ground.

Another problem solved by this invention is that it increases safety, as when the closure member is closed, the load is not free to drop back on the operator when the load is lifted to, or deposited at, a high level.

Another problem solved by this invention is that the closure member front is shaped so that the closure member may be closed and the apparatus operated like a conventional bulldozer. The operator could bulldoze, pick up a rock, or other object and return to bulldozing without having to take the time to carry the object to a dump.

Another problem solved by this invention is that it operates at higher efficiency and increases tire and tractor life with less strain on the tractor.

Another problem solved by this invention is that it can be mounted on existing buckets.

Another problem solved by this invention is that when dumping loose material from the bucket, the rate of material dispensing can be controlled by controlling the distance between the closure member front edge and the bucket bottom edge and, also, in this invention, the material does not leak out of the sides between the closure and bucket since there is no gap there as there is, when, as in the prior art, the closure member back edge is hinged to the bucket top edge.

SUMMARY OF THE INVENTION

A movable loading bucket is provided. A closure member having a first closure member side and second closure member side is pivotally mounted to the bucket with the first closure member side pivotally mounted to the first bucket side and the second closure member side pivotally mounted to the second bucket side. The closure member may be moved to form an enclosure with the bucket or the closure member may be moved back over the bucket so that the bucket may be used conventionally. A first closure member extensible hydraulic ram and second closure member extensible hydraulic ram are provided to move the closure member through a cable apparatus. The closure member front portion is concave in shape so that when the closure member is fully forward the apparatus may be used for conventional bulldozing, grading and the like.

DESCRIPTION OF THE PREFERRED EMBODIMENT

Figure 1:
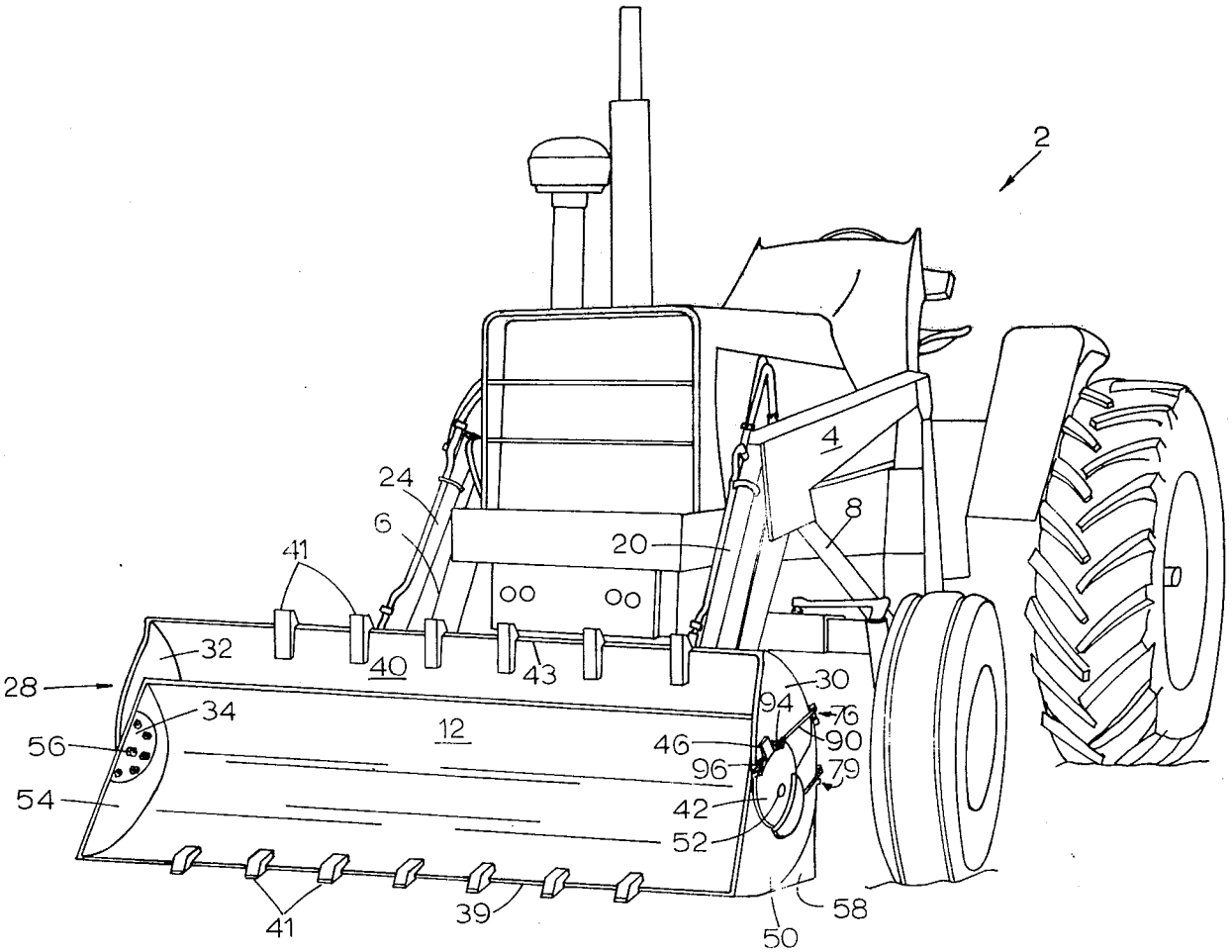
FIG. 1 is a front perspective view of a tractor with the bucket and closure member apparatus.
Figure 3:
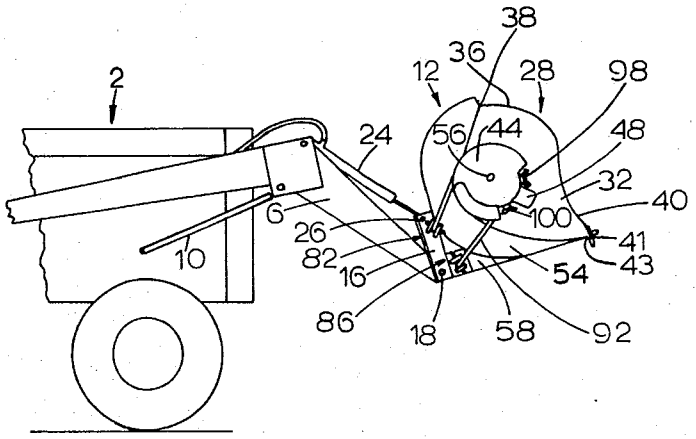
FIG. 3 is a partial side elevation view of the tractor and bucket and closure member with the bucket substantially high and with the closure member in the closed position.
Figure 2:
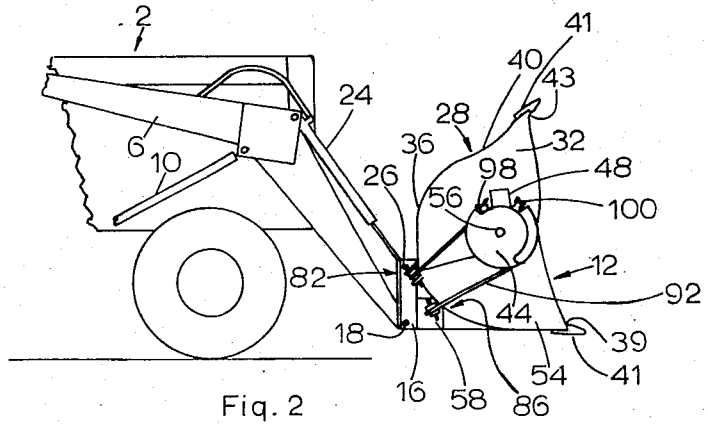
FIG. 2 is a partial side elevation view of the tractor and bucket and closure member apparatus with the bucket low and with the closure member in the open position.

Referring in detail to the drawings, a tractor 2 is provided. A first arm 4 and a second arm 6 are pivotally mounted to the tractor 2. The first arm 4 is moved by a first extensible hydraulic ram 8 pivotally mounted at one end to the tractor 2 and at the other end to the first arm 4. The second arm 6 is moved by a second extensible hydraulic ram 10 pivotally mounted at one end to the tractor 2 and at the other end to the second arm 6. Conventional hydraulic controls (not shown) are provided for the tractor operator to actuate the first hydraulic ram 8 and second hydraulic ram 10 to raise and lower first arm 4 and second arm 6.

A bucket 12 having a generally arcuate rear wall is provided. A first bracket 14 and second bracket 16 are mounted to the back of the bucket 12 as by welding. The bucket 12 and first bracket 14 and second bracket 16 are pivotally mounted to the ends of first arm 4 and second arm 6 by means of a first pin (not shown) journaled through the end of first arm 4 and first bracket 14 and a second pin 18 journaled through the end of second arm 6 and second bracket 16. To provide controlled rocking movement of the bucket 12 a third extensible hydraulic ram 20 is pivotally mounted at one end to the first arm 4 and at the other end to first bracket 14 by means of third pin 22 journaled through the end of third hydraulic ram 20 and first bracket 14. Similarly, a fourth extensible hydraulic ram 24 is pivotally mounted at one end to second arm 6 and at the other end to second bracket 16 by means of a fourth pin 26 journaled through the end of the fourth hydraulic ram 24 and second bracket 16. It can now be seen, that by proper operation of the hydraulic controls, the operator can raise or lower the bucket 12 and can also selectively and pivotally move the plane of the mouth of the bucket 12 forward or rearward.

A closure member 28 having a closure member first side 30 and a closure member second side 32 is provided. The closure member first side 30 and closure member second side 32 act as radius arms, the length of which is the distance between the closure member first side 30 and closure member second side 32 pivot points and closure member 28. A first reinforcing member (not shown) and a second reinforcing member 34 are mounted on the bucket first side 50 and bucket second side 54, respectively, at the pivot points on the bucket 12 to reinforce the pivot points. The closure member back portion 36 is convex in shape and complementary in shape to the top portion of the bucket 12 that the closure member back portion 36 moves over when the closure 28 is in the fully rearward position. The closure member first side 30 and closure member second side 32 extend rearward farther than the transverse closure member back edge 38 so that the closure member back edge 38 does not strike the first bracket 14 and second bracket 16 when the closure member 28 is moved to the fully rearward position. The closure member front portion 40 is concave in shape so that when the closure member 28 is moved to the fully forward position the closure member front portion 40 may be used for bulldozing, grading or the like. If desired, as for picking up brush, removable, interlocking conventional teeth 41 may be removably mounted by bolts to the bucket bottom edge 39 and closure member front edge 43. A first rotating member 42 is mounted, as by welding, to the outside of the closure member first side 30 over the closure member 28 pivot point. A second rotating member 44 is mounted to the outside of the closure member second side 32 over the closure member 28 pivot point. The first rotating member 42 and second rotating member 44 both have grooves (not shown) around the periphery for reasons to be explained later. A first stop 46 and second stop 48 are welded to the closure member first side 30 and closure member second side 32 respectively and abut the first rotating member 42 and second rotating member 44, respectively, for the reasons to be explained below. The closure member first side 30 is rotatably mounted to the bucket first side 50 by fifth pin 52 journaled through the first rotating member 42, closure member first side 30, bucket first side 50 and the first reinforcing member (not shown). The closure member second side 32 is pivotally mounted to the bucket second side 54 by sixth pin 56 journaled through second rotating member 44, closure member second side 32, bucket second side 54 and second reinforcing member 34. The closure member 28 is co-extensive with the mouth of the bucket 12 and can be moved fully forward to form a material tight enclosure for the material to be handled, or the closure member 28 may be moved fully rearward and the bucket 12 used in the conventional way, or the closure member 28 may be moved fully forward and used for bulldozing or grading or any other similar desired use. The closure member first side 30 is adjacent and parallel to bucket first side 50 and the closure member second side 32 is adjacent and parallel to bucket second side 54.

Figure 4:
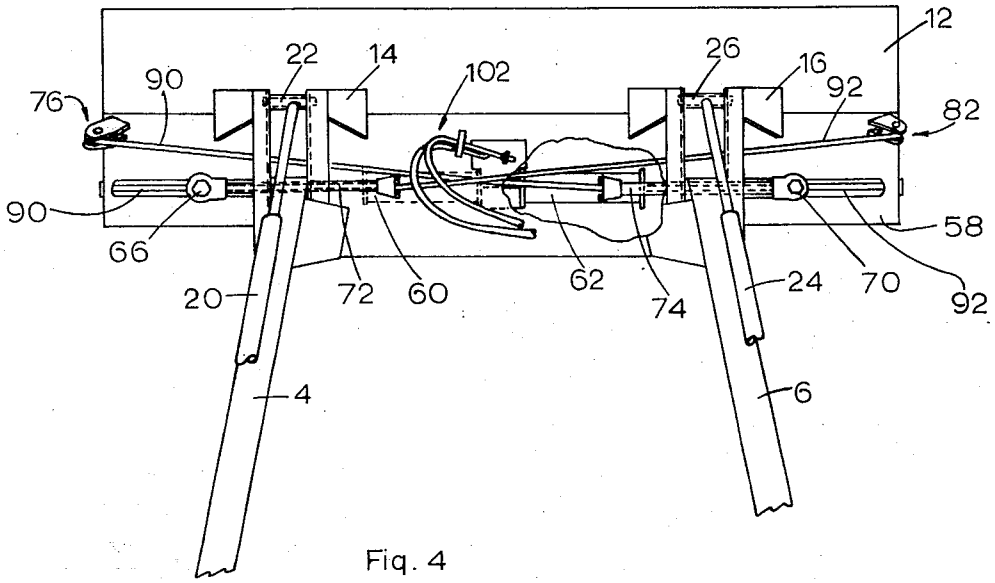
FIG. 4 is an enlarged, partial top perspective view, partially in section showing the bucket and closure member apparatus and also showing the hydraulic rams and cables for operating the closure member.
Figure 5:
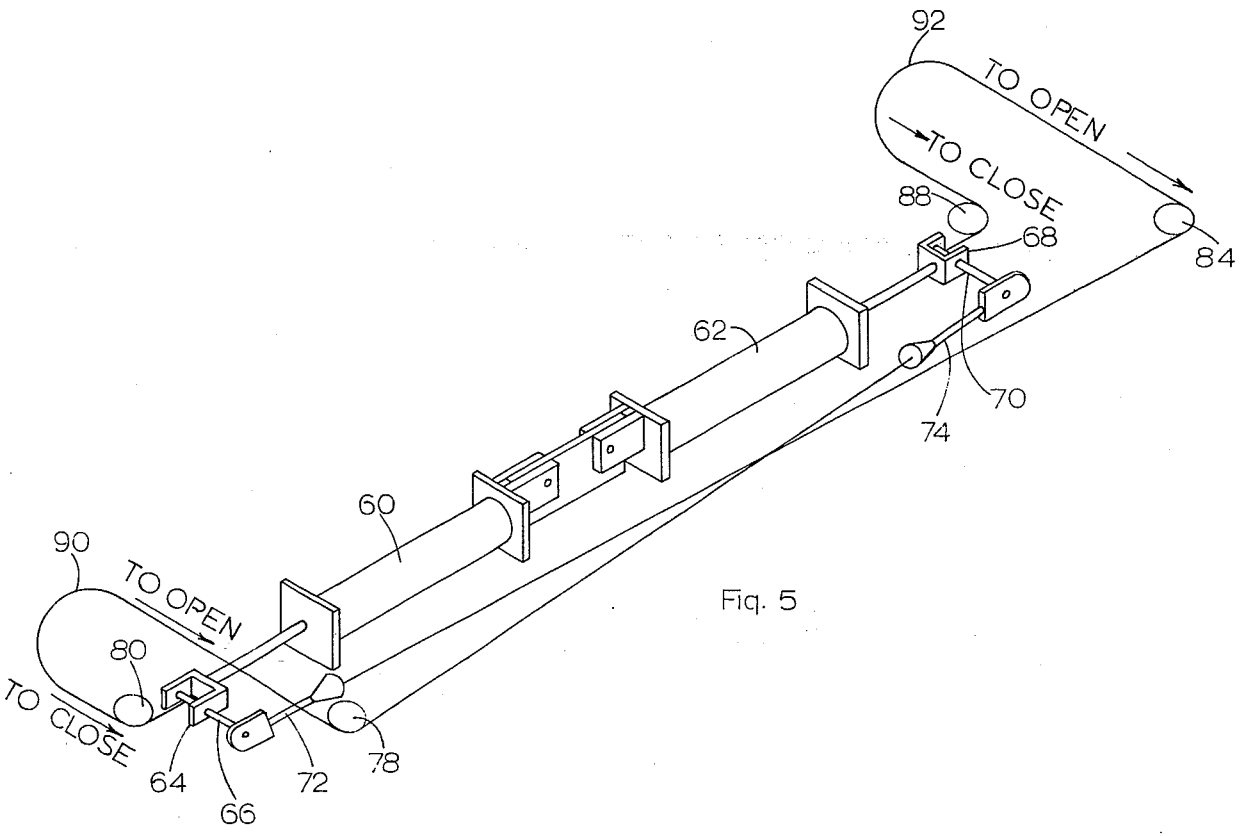
FIG. 5 is a diagrammatic drawing showing the operation of the hydraulic rams and cables for operating the closure member.

A housing 58 is mounted, as by welding to the back of the bucket 12. A first closure member extensible hydraulic ram 60 and second closure member extensible hydraulic ram 62 are mounted laterally, as by welding, to the housing 58. A cable apparatus is provided for moving the closure member 28 by the ram 60 and ram 62 as best seen in FIG. 4 and FIG. 5. A first connecting member 64 having a first rod 66 is mounted to the end of the rod of the first closure member hydraulic ram 60 and a second connecting member 68 having a second rod 70 is mounted to the end of the rod of the second hydraulic ram 62. A first cable connecting member 72 is mounted to the end of rod 66 and a second cable connecting member 74 is connected to the end of second rod 70. A first roller assembly 76 having a first grooved roller 78 rotatably mounted thereon is mounted to the corner of housing 58. Similarly, a second roller assembly 79, having a second grooved roller 80 rotatably mounted thereon is mounted to the corner of housing 58 below the first roller assembly 76. A third roller assembly 82 having a third grooved roller 84 rotatably mounted thereon is mounted to the opposite corner of housing 58. Similarly, a fourth roller assembly 86 having a fourth grooved roller 88 rotatably mounted thereon is mounted to the opposite corner of housing 58 below third roller assembly 82. A first cable 90 is connected to the first connecting member 64, brought around second grooved roller 80, brought around and in the groove of first rotating member 42, brought back around first grooved roller 78 and tightly connected to the end of second cable connecting member 74. Similarly, a second cable 92 is connected to the second connecting member 68, brought around fourth grooved roller 88, looped around and in the groove of second rotating member 44, brought back and around third grooved roller 84 and connected tightly to the end of first cable connecting member 72. To prevent first cable 90 from slipping in the groove of first rotating member 42, a first U-bolt 94 and a second U-bolt 96 are tightly mounted to the first cable 90 on opposite sides of and abutting the first stop 46. Similarly, to prevent second cable 92 from slipping in the groove of second rotating member 44, a third U-bolt 98 and fourth U-bolt 100 are tightly mounted to second cable 92 on opposite sides of and abutting the second stop 48. Now, as best seen in FIG. 5, by proper operation of the hydraulic controls, including hydraulic hoses 102, the closure member 28 may be moved forward and rearward. When the hydraulic controls are operated to extend both the rods of the first closure member hydraulic ram 60 and second closure member hydraulic ram 62 outwardly the first cable 90 and second cable 92 are pulled to rotate the closure member 28 rearward to expose the bucket 12 for ordinary dumping or ordinary bucket 12 work. When the hydraulic controls are operated to move both rods of the first closure member hydraulic ram 60 and second closure member hydraulic ram 62 inwardly the first cable 90 and second cable 92 are pulled to rotate the closure member 28 forward to form a material tight enclosure for carrying material or, the closure member front portion 40 may be used to bulldoze or grade or as otherwise desired to accomplish the enumerated problems solved by this invention.

This invention, in its broader aspects, is not limited to the specific manufacture shown and described, but departure may be made therefrom within the scope of the accompanying claims without departing from the principles of the invention and without sacrificing its chief advantages.

I claim:

1. A closure member apparatus for a load handling bucket which comprises:

a. a closure member having a closure member first side and closure member second side rotatably mounted on the bucket with the closure member first side lying over and adjacent to the bucket first side and pivotally mounted thereto and the closure member second side lying over and adjacent to the bucket second side and pivotally mounted thereto so that the closure member does not project substantially above the bucket when the closure member is in rearward position;

b. means for rotating the closure member mounted to the bucket, c. said means for rotating the closure member comprising a first closure member extensible hydraulic ram and second closure member extensible hydraulic ram mounted to the bucket; and a first cable and second cable both movably connected at opposite ends to the rod ends of the first closure member extensible hydraulic ram and second closure member extensible hydraulic ram and rigidly mounted to the closure member first side and closure member second side, respectively, intermediate the opposite ends of the first cable and second cable, for rotating the closure member.

2. A closure member apparatus for a load handling bucket as recited in claim 1 further comprising the closure member co-extensive with the mouth of the bucket so that when the closure member is moved fully forward the closure member and bucket form a material tight enclosure.

3. A closure member apparatus for a load handling bucket as recited in claim 1 further comprising the front portion of the closure member concave in shape so that the closure member may be used for bulldozing, grading and the like.

4. A closure member apparatus for a load handling bucket which comprises:

a. a closure member having a first side, second side and a front portion, the closure member co-extensive with the mouth of the bucket so that when the closure member is moved fully forward the bucket and closure member form a material tight enclosure, the closure member front portion being concave in shape so that the closure member may be used for bulldozing, grading and the like, the closure member being rotatably mounted to the bucket with the closure member first side lying over and adjacent the bucket first side and pivotally mounted thereto, and the closure member second side lying over and adjacent the bucket second side and pivotally mounted thereto so that the closure member does not project substantially above the bucket when the closure member is in the rearward position;

b. a first closure member extensible hydraulic ram and second closure member extensible hydraulic ram mounted to the bucket; and c. a first cable and second cable both movably connected at opposite ends to the rod ends of the first closure member extensible hydraulic ram and second closure member extensible hydraulic ram and rigidly mounted to the closure member first side and closure member second side, respectively, intermediate the opposite ends of the first cable and second cable for rotating the closure member.

5. A closure member and material handling bucket which comprises:

a. an open front bucket having an elongated, generally transversely arcuate rear wall and a pair of spaced apart sides;

b. an elongated, generally transversely arcuate closure member adapted for rotating to and from a position closing the bucket opening;

c. an arm for each side of the closure member, respectively, each arm being secured to its corresponding end of the closure member and extending in overlying relationship to the corresponding sides of the bucket; and d. means pivoting each arm to its corresponding bucket side in spaced relationship from the bucket rear wall, the spacing between the respective arm pivot points and the closure member being greater than the distance between the pivot points and the bucket rear wall.

6. A closure member and material handling bucket as recited in claim 5 further comprising the distance between the arm pivot points and the bucket rear wall being approximately equal to the radius of curvature of the arcuate rear wall, so that the projection of the closure member above the bucket is minimized.

7. A closure member and material handling bucket as recited in claim 5 further comprising means for rotating the closure member mounted to the bucket.

8. A closure member apparatus for a load handling bucket as recited in claim 7 further comprising the closure member co-extensive with the mouth of the bucket so that when the closure member is moved fully forward the closure member and bucket form a material tight enclosure.

9. A closure member apparatus for a load handling bucket as recited in claim 7 further comprising the front portion of the closure member concave in shape so that the closure member may be used for bulldozing, grading and the like.

10. A closure member and material handling bucket apparatus as recited in claim 7 further comprising the closure co-extensive with the mouth of the bucket so that when the closure member is moved fully forward the bucket and closure member form a material tight enclosure, and the closure member front portion being concave in shape so that the closure member may be used for bulldozing, grading and the like.

* * * * *